United States Patent [19]

Hedley

[11] Patent Number: 4,748,789

[45] Date of Patent: Jun. 7, 1988

[54] ACCESS FLOOR PANEL

[76] Inventor: Gilbert P. Hedley, 430 Westwood Ave., Westwood, N.J. 07675

[21] Appl. No.: 888,242

[22] Filed: Jul. 21, 1986

[51] Int. Cl.[4] ..... E04C 2/32

[52] U.S. Cl. ..... 52/792; 52/785; 52/814

[58] Field of Search ..... 52/785, 802, 803, 804, 52/805, 813, 814, 792

[56] References Cited

U.S. PATENT DOCUMENTS

| | | | |
|---|---|---|---|
| 185,732 | 12/1876 | Dickinson | 52/813 |
| 237,416 | 2/1881 | Tiffany | 52/813 |
| 2,867,301 | 1/1959 | Benton | 189/34 |
| 3,025,934 | 3/1962 | Spiselman et al. | 189/34 |
| 3,067,843 | 12/1962 | Rushtoh et al. | 189/34 |
| 3,110,370 | 11/1963 | Wulf et al. | 189/34 |
| 3,157,254 | 11/1964 | Spiselman et al. | 189/34 |
| 3,252,260 | 5/1966 | Mills | 52/497 |
| 3,279,134 | 10/1966 | Donovan | 52/126 |
| 3,295,272 | 1/1967 | Kanno | 52/126 |
| 3,396,501 | 8/1968 | Tate | 52/173 |
| 3,420,012 | 1/1969 | Liskey et al. | 52/126 |
| 3,548,559 | 12/1970 | Levine | 52/619 |
| 3,568,390 | 3/1971 | Swensen et al. | 52/805 |
| 3,696,578 | 10/1972 | Swensen et al. | 52/618 |
| 3,811,237 | 5/1974 | Bettinger | 52/126 |
| 3,992,839 | 11/1976 | La Borde | 52/275 |
| 4,067,156 | 1/1978 | Downing, Jr. | 52/126 |
| 4,203,268 | 5/1980 | Gladden et al. | 52/630 |
| 4,220,100 | 9/1980 | Palomo | 52/802 |
| 4,411,121 | 10/1983 | Blacklin et al. | 52/792 |
| 4,426,824 | 1/1984 | Swensen | 52/794 |
| 4,442,645 | 4/1984 | Hiller et al. | 52/221 |
| 4,505,449 | 3/1985 | Turner et al. | 248/669 |
| 4,574,555 | 3/1986 | Cline | 52/785 |
| 4,596,095 | 6/1986 | Chalfant | 52/126.6 |

FOREIGN PATENT DOCUMENTS

| | | |
|---|---|---|
| 549809 | 12/1957 | Canada . |
| 2328179 | 12/1974 | Fed. Rep. of Germany . |
| 462428 | 3/1951 | Italy . |
| 1173665 | 12/1969 | United Kingdom . |

*Primary Examiner*—Carl D. Friedman
*Assistant Examiner*—Michael Safavi
*Attorney, Agent, or Firm*—Cesari and McKenna

[57] ABSTRACT

A floor panel suitable for use in access floors or other applications comprises a surface plate attached to a base plate. The base plate integrally comprises a perimeter ridge, four arcuate ridges and two diagonal ridges. The ridges are arranged so as to define four recessed areas or pockets which are located, respectively, in the corner areas of the base plate. The ridges further define four intermediate pockets in the areas between adjacent corner pockets. A reinforcing rib may be disposed within one or more of the intermediate pockets for increased strength.

4 Claims, 1 Drawing Sheet

ACCESS FLOOR PANEL

CROSS REFERENCE TO RELATED PATENT APPLICATIONS

This application is related to copending applications Ser. No. 887,740, filed July 18, 1986, entitled "Composite-Access Floor Panel", invented by Francis H. Chase, III, and Ser. No. 887,544, filed July 18, 1986, entitled "Access Floor Panel", invented by Francis H. Chase, III.

BACKGROUND OF THE INVENTION

This invention relates to floor panels for "access" or elevated floors in which individual panels may be removed by the user to gain access to the area located beneath the surface of the floor. Access floors are used in a variety of applications, particularly in rooms which house computer equipment. Such rooms require a stable floor surface which can both support the sensitive equipment as well as provide easy access for the cabling associated with peripheral devices, user terminals and other equipment. The space beneath the access floor may also serve as a distribution plenum in an air conditioning system.

In general, access floor panels known in the prior art display several disadvantages. For example, the panel must achieve a sufficiently high strength to weight ratio so that it may bear its load without collapsing. In addition, the loaded panel should produce small deflections in order to maintain a substantially flat floor surface. Finally, the cost of the finished product is a function of the complexity of the design and the associated tooling or processing required to fabricate it. Thus, a simplified structure may result in significant cost reduction.

SUMMARY OF THE INVENTION

The present invention provides a floor panel which is suitable for use in access floors and other applications. The panel exhibits an improved strength to weight ratio and produces marginal deflections when loaded. In addition, the cost of the finished product may be reduced as a result of the simplified structure.

The panel comprises a surface plate and a base plate which are joined together. The surface plate comprises substantially flat top and bottom surfaces. The base plate comprises a plurality of integral folds or ridges, whereby a plurality of "pockets" or recessed areas are defined. A perimeter ridge extends laterally around the edge of the base plate. Four arcuate ridges intersect with the perimeter ridge, thereby defining four pockets, which are respectively disposed in the four corner areas of the base plate. In addition, two diagonal ridges intersect with the arcuate ridges thereby defining four intermediate pockets. Each of the intermediate pockets is disposed between a pair of adjacent corner pockets.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1:
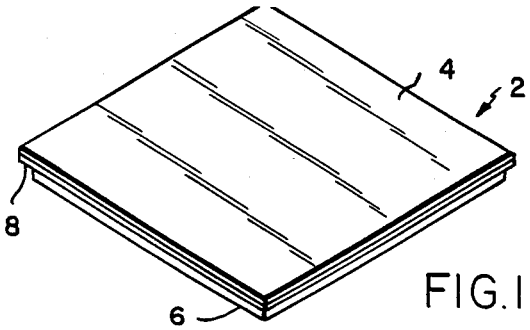
FIG. 1 is an isometric view of the preferred embodiment of an access floor panel constructed in accordance with the present invention.

FIG. 1 is an isometric view of the preferred embodiment of an access floor panel 2 constructed in accordance with the present invention. A surface plate 4 is mounted upon a base plate 6. A support lip 8 is provided by the edges of the surface plate 4 and the base plate 6. The support lip 8 extends laterally around the perimeter of the panel 2.

Figure 2:
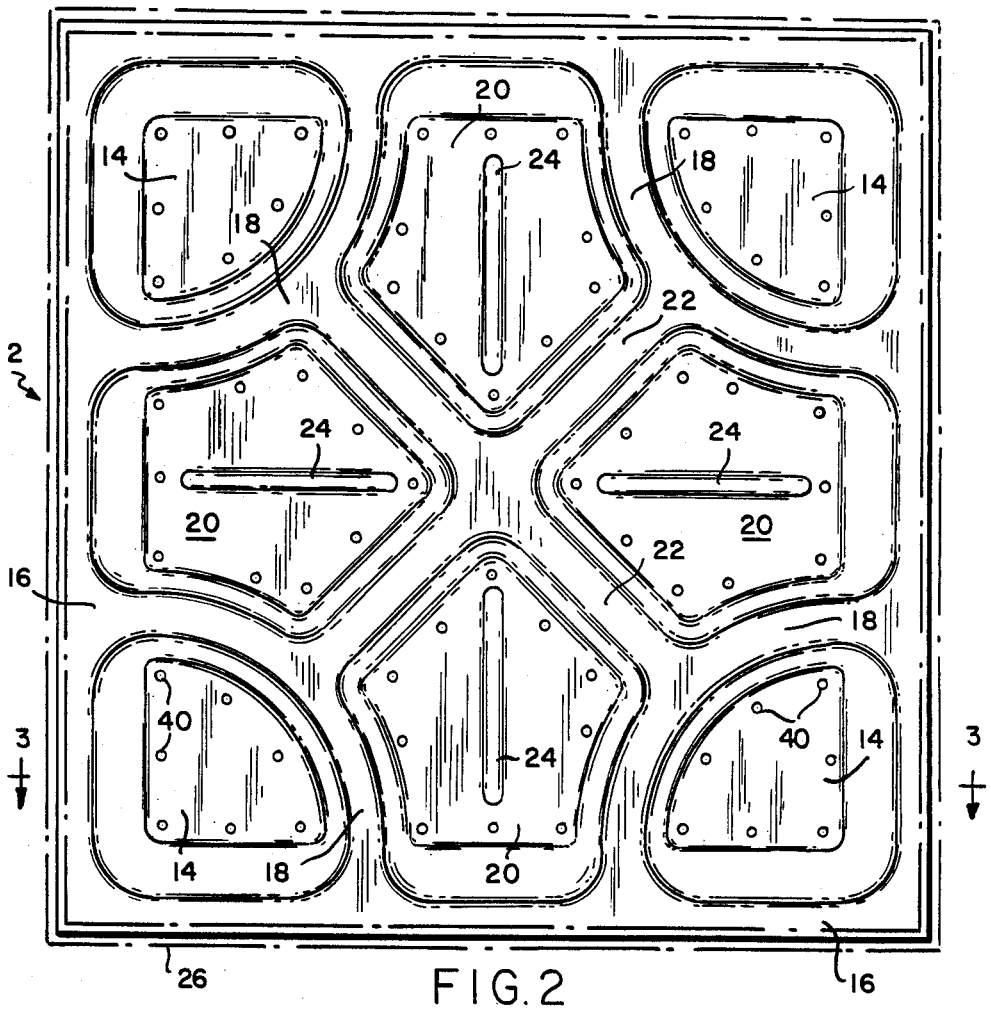
FIG. 2 is a reflective plan view of the floor panel shown in FIG. 1.
Figure 3:
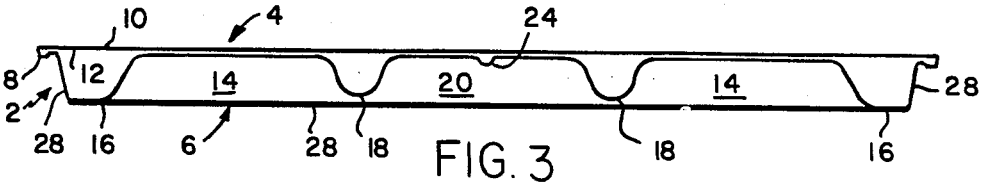
FIG. 3 is a cross-sectional view taken along line 3—3 of FIG. 2.

As may be seen more clearly in FIG. 2, which is a reflective plan view of the panel 2 shown in FIG. 1, and FIG. 3, which is a sectional view taken along line 3—3 of FIG. 2, the surface plate 4 comprises a top surface 10 and a bottom surface 12, both of which are substantially flat. In contrast, the base plate 6 comprises a plurality of integral folds or ridges which define a plurality of "pockets" or recessed areas. For clarity, the general locations of the ridges and pockets discussed below are indicated in FIG. 2.

An integral sidewall 28 extends downwardly from the support lip 8. The sidewall 28 extends laterally around the perimeter of the base plate 6, thereby forming one side of an integral perimeter ridge 16. Similarly, an integral arcuate ridge 18 is disposed within each of the four corner areas of the base plate 6. The ends of each of the arcuate ridges 18 intersect with the perimeter ridge 16, thereby defining four recessed areas or corner pockets 14 having the general shape of a quarter-circle.

Two integral diagonal ridges 22 are disposed within the interior area of the base plate 16. Specifically, the diagonal ridges 22 extend, respectively, along two imaginary lines, each of which crosses through two opposite corners of the base plate 6. The diagonal ridges 22 intersect with each other at the approximate center of the base plate 6. The ends of the diagonal ridges 22 intersect with the two arcuate ridges 18 which are disposed at opposite corners of the base plate 6. Thus, four intermediate pockets 20, disposed between pairs of adjacent corner pockets 14, are defined by the intersection of the diagonal ridges 22 with the arcuate ridges 18, in conjunction with the perimeter ridge 16. A reinforcing rib 24 is disposed within each of the intermediate pockets 20. The reinforcing ribs 24 serve to stiffen the intermediate pockets 20 and, alternatively, may be deleted depending on the strength required for a particular application.

Figure 4:
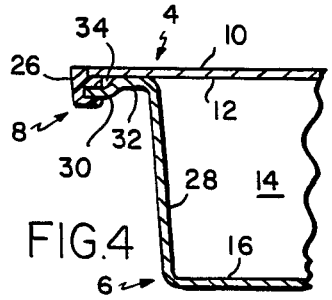
FIG. 4 is an enlarged view of the left end portion of the section shown in FIG. 3.

Referring now to FIG. 4, which is an enlarged view of a portion of the section shown in FIG. 3, the support lip 8 comprises a lateral portion 32, which extends outwardly from the sidewall 28, and an offset portion 30, which provides a gap 34 between the surface plate 4 and the base plate 6. In general, the support lip 8 may be adapted to receive any of a number of conventional access floor support systems known in the prior art, including pedestal supports.

As shown in FIG. 2 (in phantom) and FIG. 4, the floor panel 2 may be fitted with a conventional edge trim member 26 known in the prior art. The trim member 26 may comprise, for example, a plastic or metal strip which may be adapted to attach to the gap 34 and the edges of the surface plate 4 and base plate 6. The trim member 26 may be applied to the floor panel 2 with any of a number of commercially available adhesives.

The surface plate 4 and the base plate 6 may comprise, for example, steel having a thickness which may vary depending on the particular application. As shown in FIG. 2, the surface plate 4 may be attached to the base plate 6 by a plurality of spot welds 40 which are disposed around the perimeters of the various pockets 14 and 20.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. An access floor panel comprising:

substantially flat, rectangular surface plate means having a top surface, a bottom surface, and four sides connected at corners to form a perimeter; and base plate means supporting said surface place means, said base plate means being substantially coextensive with said surface plate means and connected to the bottom surface of said surface plate means, wherein said base plate means comprises:

an integrally formed perimeter support lip in contact with and supporting the bottom surface of the perimeter of said surface plate means;

an integrally formed perimeter ridge coextensive with said perimeter support lip and having four sides connected at respective corners, said perimeter ridge formed with a sidewall extending downwardly and inwardly from said perimeter lip;

four integrally formed arcuate ridges having ends which intersect adjacent connected sides of said perimeter ridge;

a first group of four integral bearing surfaces in contact with and supporting said surface plate means, each of said first bearing surfaces disposed in one of four areas defined by each of the arcuate ridges and the sides of the perimeter ridge with which said arcuate ridges intersect intersects;

two integrally formed diagonal ridges, disposed on the diagonals between opposite corners of the base plate means, said diagonal ridges intersecting each other and intersecting and extending between respective opposite arcuate ridges; and a second group of four integral bearing surfaces in contact with and supporting said surface plate means, each of said second bearing surfaces disposed in one of four areas defined by each of the four included angles of the intersecting diagonal ridges, the arcuate ridges with which said diagonal ridges intersect, and portions of the perimeter ridge extending between pairs of said arcuate ridges.

2. The floor panel of claim 1 wherein each of said first group of bearing surfaces is substantially a quarter-circle sector in shape.

3. The floor panel of claim 1 wherein one or more of said second group of bearing surfaces further comprises a reinforcing rib.

4. The floor panel of claim 3 wherein each of said reinforcing ribs is disposed on a line extending perpendicularly from a side of the base plate means towards the center of the base plate means.

* * * * *